US005083342A

United States Patent [19]

Klinefelter

[11] Patent Number: 5,083,342

[45] Date of Patent: Jan. 28, 1992

[54] DOOR CLOSURE DELAY DEVICE

[76] Inventor: Howard W. Klinefelter, 6121 NW. North Hills Dr., Topeka, Kans. 66617

[21] Appl. No.: 620,759

[22] Filed: Dec. 3, 1990

[51] Int. Cl.[5] ..... E05F 3/02

[52] U.S. Cl. ..... 16/66; 16/70

[58] Field of Search ..... 16/66, 62, 51, 67–70

[56] References Cited

U.S. PATENT DOCUMENTS 4,339,843 7/1982 Burnett, Jr. ..... 16/62

4,639,969 2/1987 Obenshain ..... 16/66

*Primary Examiner*—Robert L. Spruill

*Assistant Examiner*—Carmine Cuda

*Attorney, Agent, or Firm*—Hovey, Williams, Timmons & Collins

[57] ABSTRACT

A door closure delay device is provided for connection to a door and a frame, whereby the user may delay the closing of the door by actuating a pneumatic timer which is coupled to a pneumatic or hydraulic door closer. The door closer includes a housing, a shaft extending outwardly from the interior of the housing, and a piston or other means for pressurizing the fluid within the housing. The timer includes a control mechanism for setting the amount of time desired to keep the door open, and a timing valve which is normally open but closes when the timer is actuated. When the door is opened and the pneumatic or hydraulic timer actuated, the door remains open for the selected period of time during which the timing valve prevents fluid pressurized within the housing from escaping, and upon the expiration of the selected time period, the timing valve opens and allows the door to close. The device hereof may be provided as either a complete door closer unit or as an addition to an existing pneumatic or hydraulic door closer assembly.

3 Claims, 1 Drawing Sheet

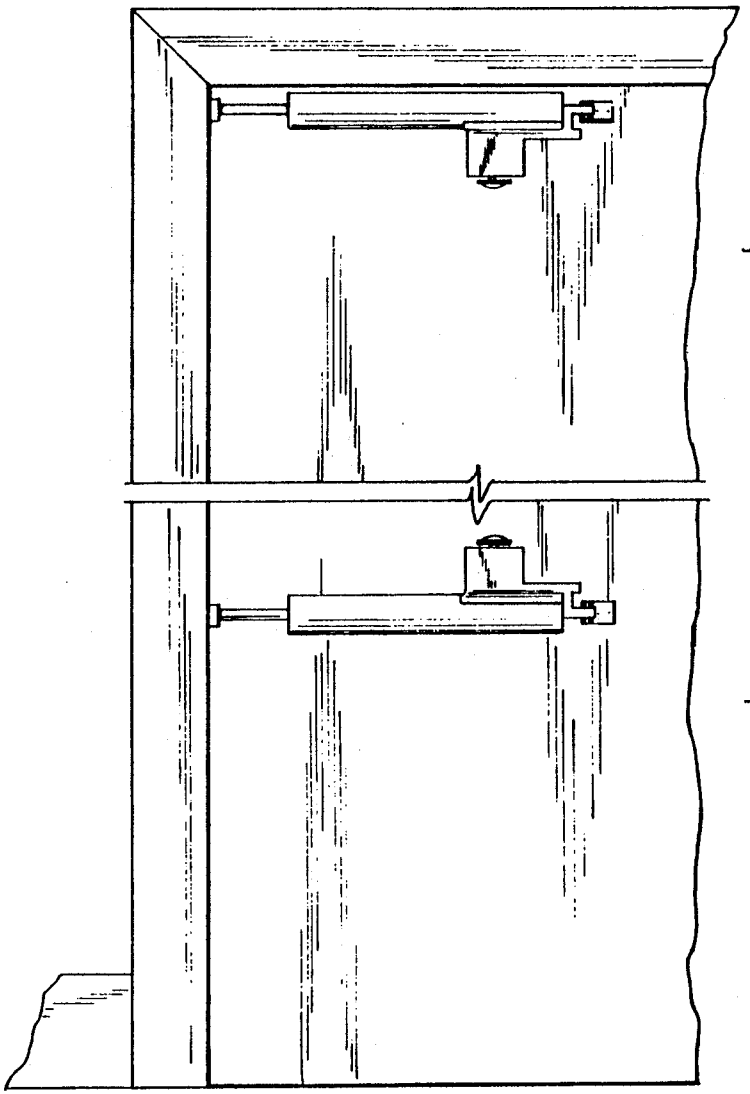
Fig. 4
Fig. 5
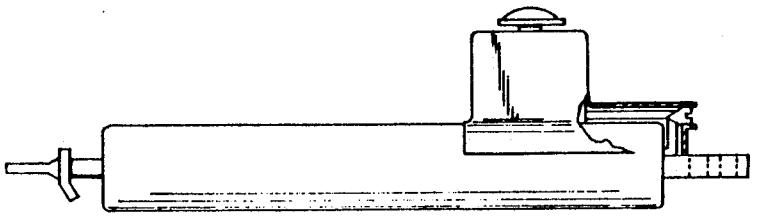
Fig. 1
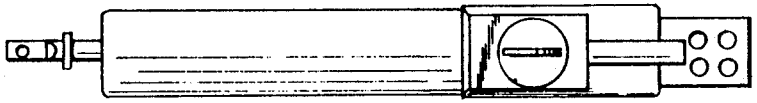
Fig. 2
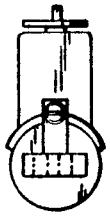
Fig. 3

DOOR CLOSURE DELAY DEVICE

BACKGROUND OF THE INVENTION

1. Field of the Invention

This invention relates to a door closure device and more particularly to a device for delaying the closing of a door for a predetermined period as selected by the user. The door closure delay device hereof is designed for operation in conjunction with a pneumatic door closer and serves to prevent air pressurized within the housing of the door closer from escaping for a predetermined period.

2. Description of the Prior Art

Pneumatic door closers are devices which are coupled to a door and a surrounding frame to bias a door to a closing position. They also serve to retard the rate at which the door closes so as to prevent the door from "slamming " when the user releases the door to enable it to return. These door closers conventionally employ a cylindrical housing which carry a spring and a piston. The piston shifts along the interior of the housing and draws air into the housing when the door is opened and then forces the air back out when shifting back to a closed position. The rate at which the door closes is determined by the spring tension and a valve which limits the flow of air out of the housing.

Such pneumatic door closers are often provided with a stop which is slidably located along a shaft connected to the piston and the door. The stop enables the door to be held in a desired open position or can be moved along the shaft so that the door may completely close. Thus, a door can be propped open allowed to pivot between an open and closed position, but there is no provision for a delay in the amount of time the door can be held open before automatically closing by virtue of the biasing spring.

Other devices have been developed which hold a door open at a desired position. One such device is sold by Brookstone of Peterborough, N.H. which may be attached to a pneumatic closer to hold a door open at a desired position. However, this device must be manually released and does not contemplate a delay in closing.

The problem thus encountered by homeowners is the need to keep a door open for a preselected period of time in order to bring in groceries or perform other chores which occupy both hands and then have the door automatically close. Closing the door automatically saves energy costs associated with the additional heating or cooling caused by excessive flow of air through a door held open too long, or the entry into the home of insects or other pests which would otherwise be stopped by the closed door.

SUMMARY OF THE INVENTION

The present invention solves these problems by providing an economical unit which delays the closing of a door and then, upon the expiration of a preselected time period as determined by the user, permits the door to close in its normal operating cycle. The invention advantageously operates by using a pneumatic control thus avoiding the need for remote power sources and operates independently on the air supply which is normally a part of a pneumatic or hydraulic circuit. It is thus ideally suited for operating in remote locations and can be used in the normal manner of existing pneumatic door closers. The unit hereof may be provided as either a complete door closure unit or as an add-on to an existing unit.

When provided as a complete unit, the door closure device hereof broadly includes a door closer cylinder having a housing containing a piston shiftable therewithin, the piston being coupled to a shaft extending from the interior of the housing. The piston serves to expel and intake air into the housing, and to that end a conduit or other fluid connecting means is provided for connecting the cylinder to a pneumatic timer. The timer includes a control for enabling the user to select a period of delay and a timing value for preventing the movement of fluid through the timer once the user actuates the device. The shaft and housing are provided with brackets or other means for connecting to the door and frame, with such connections preferably being pivotal connections. A restriction valve is preferably included between the housing and the timing valve for limiting the movement of fluid therethrough, so that upon opening of the timing valve, the door will gradually close due to the restriction of fluid flow.

The device hereof may also be provided as an addition to an existing pneumatic door closer. In that configuration, the pneumatic timer as outlined above is attached to the closer and tubing or other fluid connection is used to connect the outlet of the housing to the pneumatic timer. A restriction valve is preferably provided for the purposes as set forth above.

BRIEF DESCRIPTION OF THE DRAWINGS

FIG. 1 is a front elevational view of the door closer device of the present invention with parts broken away, parts shown in phantom, and parts shown in section for clarity;

FIG. 2 is a top plan view of the door closer device shown in FIG. 1;

FIG. 3 is a right side elevational view of the door closer device shown in FIG. 1;

FIG. 4 is a fragmentary front elevational view showing the door closer device hereof mounted to a door and surrounding frame; and FIG. 5 is a fragmentary front elevational view showing the door closer device of FIG. 4 mounted in an inverted position when mounted relatively lower to the bottom of the door than in FIG. 4.

DESCRIPTION OF THE PREFERRED EMBODIMENT

Referring now to the drawing, a door closure device 10 broadly includes a pneumatic timing unit 12, connection means 14, restriction valve 16 and door closure cylinder 18. Pneumatic timing unit 12 may be enclosed in a cover 20 and mounted to cylinder 18 to present a self-contained unit.

In greater detail, pneumatic timing unit 12 is a spring-wound timing control unit provided with a pneumatic valve having a fluid inlet 22 and a fluid outlet. A particularly useful pneumatic timing unit is a 909 series pneumatic wall box time switch sold by M. H. Rhodes, Inc of Avon, Conn. under the trademark "Mark Time". Because those units are conventionally provided with timing periods far in excess of that desired for a door closure delay device, I have found that a unit having a modified spring mechanism providing a closed timing valve in the range of 15 to 120 seconds is especially useful in the present invention. The timing unit hereof is provided as a self-contained unit having with a rotatable control rod 24 extended exteriorly of cover 20 to receive thereon a control knob 26. Cover 20 may be removably mounted on door closure cylinder 18 or attached by other conventional means such as soldering, adhesive or the like.

Door closure cylinder 18 broadly includes a housing 28 which receives a piston 29 within the interior 30 of the housing for pressurizing fluid within the housing. The piston is reciprocally slidable within the housing 28 and is connected to shaft 31 which extends outwardly from the interior 30 thereof. This piston is provided with a surrounding gasket or seal to effectuate a sealing engagement with the housing 28 for pressurizing air within the housing 28. A spring 32 interconnects the housing and the piston 29 for biasing the shaft 31 and piston 29 to a normally closed position. The shaft 31 includes a mounting hole 33 for attachment of the shaft 31 to a mounting bracket 34, as shown in FIGS. 4 and 5. A conventional door closer stop 36 is slidably located on the shaft for mechanically engaging the housing 28 in the event the user desires to prop a door open for an extended period. I have found that an existing door closer which advantageously includes these components is sold as Model V120 by Wright Products, Inc. of Rice Lake, Wis. In the self-contained device 10 shown herein, a needle valve ordinarily provided with the door closer for exhausting air from the interior of the housing 28 is preferably removed to permit the door closer to be fluidically connected to the timing unit 12 by connection means 14.

Connection means 14 preferably includes a conduit 38 providing a direct, airtight connection between an exhaust port 40 of the housing 28 and the restriction valve 16. Restriction valve 16 includes a threaded screw 42 with a conical head configured to seat within the valve 16 and thereby restrict the flow of air or other fluid through the conduit 38, and therefore the timing unit 12 as well. A conduit 44 connects with the inlet 22 whereby air exhausted from exhaust port 40 is transmitted through restriction valve 42 prior to entering timing unit 12.

The housing 28 is preferably provided with a mounting flange 46 which is provided with a plurality of mounting apertures 48. The mounting apertures 48 are adapted to receive therein a pin 50 whereby the flange 46 may be pivotally connected to a bracket 52 on either side in alternate positions to accommodate different mounting positions. As shown in FIG. 4, the bracket 52 is mounted to a door 54 which is hinged on the left side of the door. The device 10 is mounted near the top of the door 54 with the control knob 26 oriented downwardly for ease of use. In this configuration, the pin 50 would be located in either mounting aperture 48A or 48B. Alternatively, the device 10 hereof could be mounted more proximate to the lower part of the door 54 as shown in FIG. 5, in which case the control knob 26 would be positioned in an upright orientation and the pin 50 inserted in either mounting aperture 48C or 48D. In either event, a second pin 50 would be inserted through mounting hole 33 for pivotally mounting the shaft 31 to a door frame 56.

In operation, the user need only open the door 54 a desired amount and then turn the control knob 26 to the desired delay setting. Air or other fluid drawn into the interior of the housing 28 by the piston 29 connected to shaft 31 is then prevented from escaping by the now-closed timing valve in the timing unit. The door 54 then remains open for the desired period which is preferably 15 to 120 seconds. Upon the expiration of the selected period, the timing valve in the timing unit 12 opens, permitting the air held within the housing 28 to escape through conduit 38 and through the timing unit 12. If the user desires to shorten the period he or she previously selected, it is only necessary to turn the control knob 26 to the new setting. To close the door prior to expiration of the previously set period it is only necessary to turn the control knob 26 to the zero position. This will permit the door to close immediately. The restriction valve 16 serves to limit the rate at which the door closes by limiting the rate at which the air may reach and be released through the timing unit 12. To adjust the rate at which the door 54 closes, the user need only rotate the screw 42 to increase or decrease the opening between the screw and the conduit 38. If the user desires to prop the door open for an indefinite period, the timing device hereof does not interfere with the use of stop 36 to engage the housing 28 and thereby prevent the door from closing by conventional means.

It may be further appreciated that my invention may be retrofitted to existing door closers by mounting a timing unit 12 in proximity to a conventional door closer and removing the existing needle valve. A conduit 38 may be inserted into the opening the needle valve previously occupied and a restriction valve 16 interposed between the opening and the inlet to the timing unit. The delay device is then ready to use as set forth above.

A number of modifications may be made to the invention set forth above by those skilled in the art without departing from the spirit thereof as set forth in the following claims.

I claim:

1. A self-contained door closure device for selectively delaying the closure of a frame-mounted door for a predetermined period of time, said device comprising:

closure means adapted for connection between said door and frame for biasing the door to a closed position, including a pneumatic door closure cylinder presenting an inner chamber, a port communicating said chamber with ambient air, a piston slidable within the chamber, and a rod connected to said piston and slidable therewith;

said closure means being operable for drawing ambient air into said chamber when said piston moves therein in response to opening of said door, and for expelling drawn-in ambient air through said port during closing of said door;

pneumatic timing means for selectively interrupting the flow of ambient air therethrough for said predetermined time period, said timing means including a fluid inlet, a fluid outlet coupled with said inlet, and manually operable means for initiating said interruption period; and means directly coupling said timing means to said cylinder and with said port coupled with said timing means inlet for, upon operation of said initiation means, causing said timing means to interrupt the flow of said drawn-in ambient air from said chamber and, upon completion of said time period, permitting said drawn-in ambient air to pass through said port and timing means inlet and outlet so as to allow closing of said door.

2. A self-contained door closure device as set forth in claim 1 wherein said pneumatic coupling means includes a restriction valve for limiting the flow of air entering said fluid intake.

3. A self-contained door closure device as set forth in claim 1 wherein said pneumatic timing means includes means for adjustably selecting a period during which said air flow is interrupted, said period being in the range of 15 to 120 seconds.

* * * * *